US006935812B2

(12) United States Patent
Rainey

(10) Patent No.: US 6,935,812 B2
(45) **Date of Patent: *Aug. 30, 2005**

(54) RETAINING WALL ANCHORING SYSTEM

(75) Inventor: Thomas L. Rainey, Acworth, GA (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 7 days.

This patent is subject to a terminal disclaimer.

(21) Appl. No.: 10/720,410

(22) Filed: Nov. 24, 2003

(65) Prior Publication Data

US 2004/0131429 A1 Jul. 8, 2004

Related U.S. Application Data

(63) Continuation of application No. 09/698,934, filed on Oct. 27, 2000, now Pat. No. 6,652,196, which is a continuation of application No. 09/261,420, filed on Mar. 3, 1999, now Pat. No. 6,168,351, which is a continuation-in-part of application No. 08/846,440, filed on Apr. 30, 1997, now Pat. No. 5,921,715.

(60) Provisional application No. 60/086,843, filed on May 27, 1998.

(51) Int. Cl.[7] ..... E02D 29/02

(52) U.S. Cl. ..... 405/262; 405/284; 405/286

(58) Field of Search ..... 405/262, 284–286

(56) References Cited

U.S. PATENT DOCUMENTS

| | | | |
|---|---|---|---|
| 1,947,151 | A | 2/1934 | Caples |
| 2,110,253 | A | 3/1938 | Nedden |
| 3,490,242 | A | 1/1970 | Schnabel, Jr. |
| 3,541,798 | A | 11/1970 | Schnabel, Jr. |
| 4,193,718 | A | 3/1980 | Wahrendorf et al. |
| 4,448,571 | A | 5/1984 | Eckels |
| 4,470,728 | A | 9/1984 | Broadbent |
| 4,490,075 | A | 12/1984 | Risi et al. |

(Continued)

FOREIGN PATENT DOCUMENTS

WO PCT/GB93/02549 12/1993

OTHER PUBLICATIONS

Nicholson Construction of America brochure for Insert Wall[SM] (In–Situ Earth Reinforcing Techniques), 5 pgs. (date unknown).

Manta Ray® Engineered Earth Anchor Systems brochure for anchoring technology, 4 pgs. (date unknown).

Newscale™ Retaining Wall Systems brochure for retaining wall systems, 6 pgs., 1994.

*Primary Examiner*—Frederick L. Lagman
(74) *Attorney, Agent, or Firm*—Merchant & Gould PC

(57) ABSTRACT

A retaining wall anchoring system for a segmental retaining wall comprising a plurality of tieback rods adapted to be embedded into soil or rock with a proximal portion extending therefrom, at least one elongated force distribution member positionable directly adjacent the proximal portion of at least one of the tieback rods, a washer positionable about the proximal portions of the tieback rod in abutment with the force distribution member, and a fastener fixedly securable to the proximal portion of the tieback rod to securely clamp the washer against the force distribution member such that tensile forces imposed on the tieback rod are transmitted to the force distribution member so as to distribute these forces throughout a portion of the retaining wall.

16 Claims, 4 Drawing Sheets

U.S. PATENT DOCUMENTS 4,530,622 A 7/1985 Mercer
4,601,148 A 7/1986 Risi et al.
4,690,588 A 9/1987 Berger
4,815,897 A 3/1989 Risi et al.
4,824,293 A 4/1989 Brown et al.
4,911,582 A 3/1990 Peirce, Jr. et al.
4,914,876 A 4/1990 Forsberg
4,917,543 A 4/1990 Cole et al.
5,044,834 A 9/1991 Janopaul, Jr.
5,064,313 A 11/1991 Risi et al.
5,066,169 A 11/1991 Gavin et al.
5,248,226 A 9/1993 Risi et al.
5,257,880 A 11/1993 Janopaul, Jr.
5,294,216 A 3/1994 Sievert
D350,611 S 9/1994 Scales
5,368,414 A 11/1994 Miller
5,417,523 A 5/1995 Scales
5,511,910 A 4/1996 Scales
5,522,682 A 6/1996 Egan
5,540,525 A 7/1996 Miller et al.
5,568,998 A 10/1996 Egan et al.
5,568,999 A 10/1996 Egan et al.
5,580,191 A 12/1996 Egan
5,588,784 A 12/1996 Brandl et al.
5,595,460 A 1/1997 Miller et al.
5,607,262 A 3/1997 Martin
5,619,835 A 4/1997 Bailey, II et al.
5,622,456 A 4/1997 Risi et al.
5,673,530 A 10/1997 Bailey, II
5,697,735 A 12/1997 Egan
5,827,015 A 10/1998 Woolford et al.
5,921,715 A 7/1999 Rainey
6,050,749 A 4/2000 Khamis
6,086,288 A 7/2000 Ruel et al.
6,089,792 A 7/2000 Khamis
6,168,351 B1 1/2001 Rainey
6,652,196 B1 * 11/2003 Rainey ..... 405/262

* cited by examiner

RETAINING WALL ANCHORING SYSTEM

CROSS-REFERENCE TO RELATED APPLICATIONS

This application is a continuation of U.S. patent application Ser. No. 09/698,934 filed Oct. 27, 2000, entitled "Retaining Wall Anchoring System", now U.S. Pat. No. 6,652,196, which is a continuation of U.S. patent application Ser. No. 09/261,420, filed Mar. 3, 1999, now U.S. Pat. No. 6,168,351, entitled "Retaining Wall Anchoring System", which is a continuation-in-pan of U.S. application Ser. No. 08/846,440, filed Apr. 30, 1997, now U.S. Pat. No. 5,921,715, entitled "Retaining Wall and Method" and which claims the benefit of the filing date of U.S. Provisional Application Ser. No. 60/086,843, filed May 27,1998, entitled "Retaining Wall Anchoring System", all of which are incorporated herein by reference.

FIELD OF THE INVENTION

The invention relates generally to earth reinforcement. More particularly, the invention relates to a segmental retaining wall anchoring system for securing segmental retaining walls.

BACKGROUND OF THE INVENTION

Segmental earth retaining walls are commonly used for architectural and site development applications. Such walls are subjected to very high pressures exerted by lateral movements of the soil, temperature and shrinkage effects, and seismic loads. Therefore, the backfill soil typically must be braced with tensile reinforcement members.

Often, elongated structures, commonly referred to as geogrids or reinforcement fabrics, are used to provide this reinforcement. Geogrids often are configured in a lattice arrangement and are constructed of a metal or polymer, while reinforcement fabrics are constructed of woven or nonwoven polymers (e.g., polymer fibers). These reinforcement members typically extend rearwardly from the wall and into the soil. The weight of the soil constrains the fabric from lateral movement to thereby stabilize the retaining wall.

SUMMARY OF THE INVENTION

Briefly described, the present invention relates to a retaining wall anchoring system for a segmental retaining wall comprising a plurality of tieback rods adapted to be embedded into soil or rock with a proximal portion extending therefrom. The system includes at least one elongated force distribution member positionable directly adjacent the proximal portion of the tieback rods, at least one washer positionable about the proximal portions of at least one tieback rod in abutment with the force distribution member, and at least one fastener fixedly securable to the proximal portion of the tieback rod to securely clamp the washer against the force distribution member such that tensile forces imposed on the tieback rod are transmitted to the distribution member so as to distribute these forces throughout a portion of the retaining wall.

The above described apparatus therefore can be used to construct a segmental retaining wall system comprising a retaining wall having a plurality of wall blocks stacked in ascending courses with a plurality of the wall blocks being provided with interior openings that are aligned with each other to form an inner passageway within the retaining wall. The proximal portion of each tieback rod can be extended into the inner passageway formed within the retaining wall with the elongated force distribution member positioned within the inner passageway directly adjacent the proximal portion of at least one of the tieback rods, a washer positioned about the distal portion of the tieback rods in abutment with the force distribution member, and a fastener fixedly secured to the proximal portion of the tieback rods to securely clamp the washer against the force distribution member such that tensile forces imposed on the tieback rods are transmitted to the force distribution member so as to distribute the tensile forces throughout a portion of the retaining wall.

In addition, the apparatus can be used to construct a segmental retaining wall system comprising a retaining wall having a plurality of wall blocks stacked in ascending courses to form an interior surface and an exterior surface, a plurality of tieback rods adapted to be embedded into soil or rock with a proximal portion extending therefrom, the proximal portion of each tieback rod extending toward the interior surface of the retaining wall, at least one elongated force distribution member positioned adjacent the interior surface of the retaining wall and directly adjacent the proximal portion of at least one tieback rod, a washer positioned about the distal portion of the tieback rod in abutment with the force distribution member, a fastener fixedly secured to the proximal portion of the tieback rod to securely clamp the washer against the force distribution member, and a reinforcement member connected to the force distribution member and being securely attached to the retaining wall such that tensile forces imposed on the tieback rods are transmitted to the force distribution member and through the reinforcement member to the retaining wall so as to distribute the tensile forces throughout a portion of the retaining wall.

DETAILED DESCRIPTION

Figure 1:
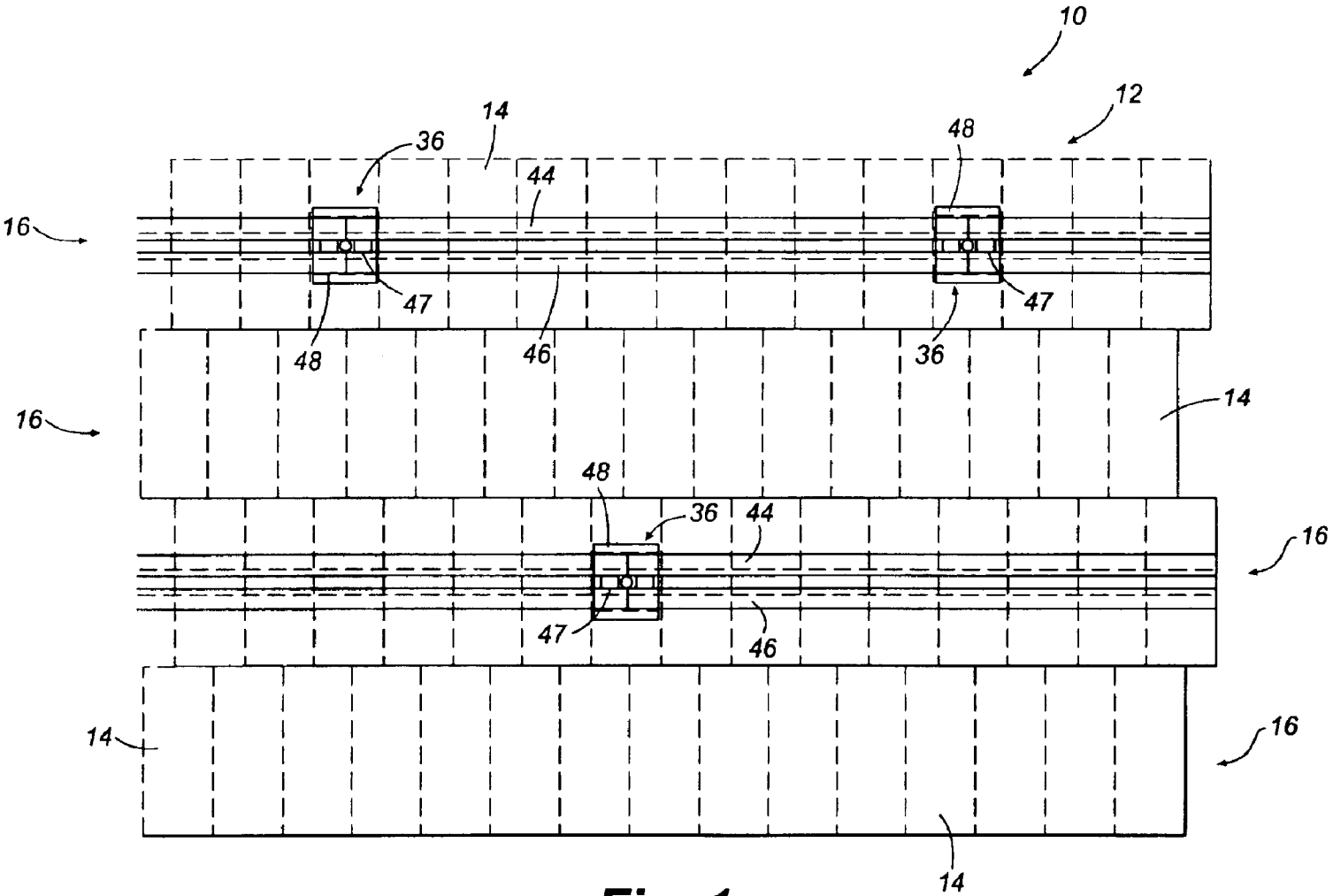
FIG. 1 is a front view of a retaining wall secured with an anchoring system constructed in accordance with the present invention.
Figure 3:
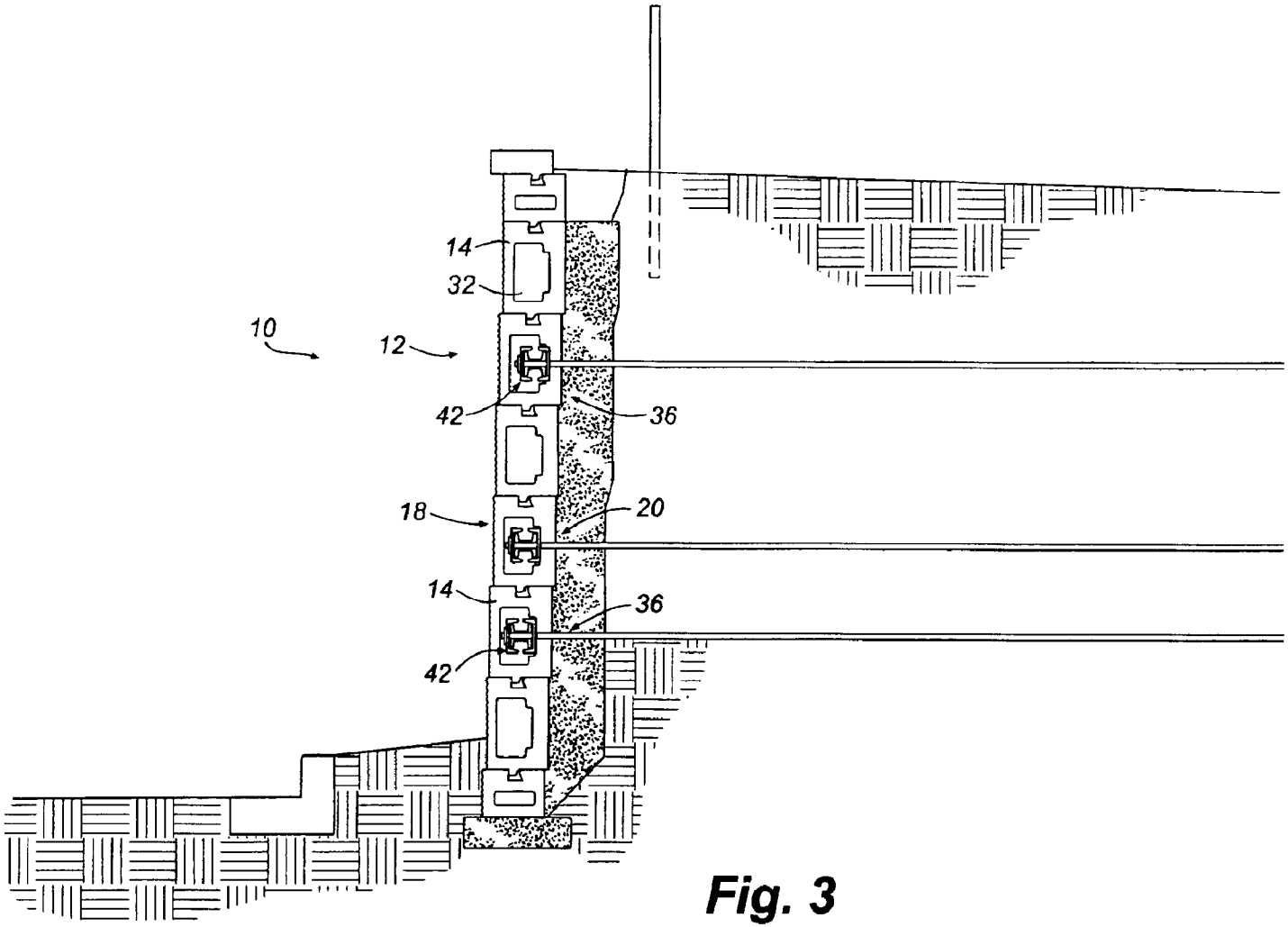
FIG. 3 is a partial cross-sectional view of a retaining wall secured with an anchoring system constructed in accordance with the present invention.

Referring now in detail to the drawings, in which like numerals indicate corresponding parts throughout the several views, FIG. 1 illustrates a modular retaining wall 10 secured with a first embodiment 12 of an anchoring system constructed in accordance with the present invention. As depicted in this figure, the retaining wall 10 comprises a plurality of wall blocks 14 that are stacked atop each other in ascending courses 16. When stacked in this manner, the wall blocks 14 together form an exterior surface 18 of the wall 10 which faces outwardly away from an earth embankment, and an interior surface 20 of the wall 10 which faces inwardly toward the embankment (FIG. 3). Typically, the blocks 14 are stacked in a staggered arrangement as shown in FIG. 1 to provide greater stability to the wall 10.

Generally speaking, the blocks 14 are substantially identical in size and shape for ease of block fabrication and wall construction, although it will be understood that unidentical blocks could be used, especially for cap blocks or base blocks. In a preferred configuration, each block 14 is configured so as to mate with at least one other block 14 when the blocks are stacked atop one another to form the retaining wall 10. This mating restricts relative movement between vertically adjacent blocks in at least one horizontal direction. To provide for this mating, the blocks 14 can include locking means 22 that secure the blocks together to further increase wall stability. More particularly, each block 14 can include a lock channel 24 and a lock flange 26 that are configured so as to positively lock with each other when the blocks 14 are stacked on top of each another as disclosed in co-pending U.S. application Ser. No. 09/049,627, which is hereby incorporated by reference into the present disclosure. When the blocks 14 include lock channels 24 and flanges 26, the individual lock channels typically form a continuous lock channel that extends the length of the lower of two mating courses when the blocks are aligned side-byside within each course 16. Similarly, the lock flanges 26 form a continuous lock flange that extends the length of the upper of the mating courses 16 which is received by the continuous lock channel of the lower of the mating courses.

Although the blocks 14 preferably are provided with such locking means 22, it will be appreciated that the anchoring system of the present invention can be used with substantially any segmental retaining wall blocks. By way of example, the present system could be used with any of the blocks produced by Anchor Wall Systems, Inc. such as any block of the Anchor Diamond® and/or Anchor Vertica® product lines, or any block disclosed in U.S. Pat. No. 5,827,015, which is hereby incorporated by reference into the present disclosure. Moreover, the present system could be utilized with the segmental blocks produced by other manufacturers such as Keystone, Mesa, Versa-Lok, Newcastle, and Piza. Irrespective of the particular configuration of the wall blocks 14, each of the wall blocks typically includes an interior opening 32 that either extends through the block horizontally (side-to-side) or vertically (top-to-bottom). When the blocks 14 are correctly aligned in their respective courses 16, these openings 32 form continuous elongated passageways 34. In that, as described below, the passageways 34 typically are only used for anchoring system attachment, it is to be appreciated that only the blocks 14 that receive the system's components need be provided with such openings 32.

Figure 2:
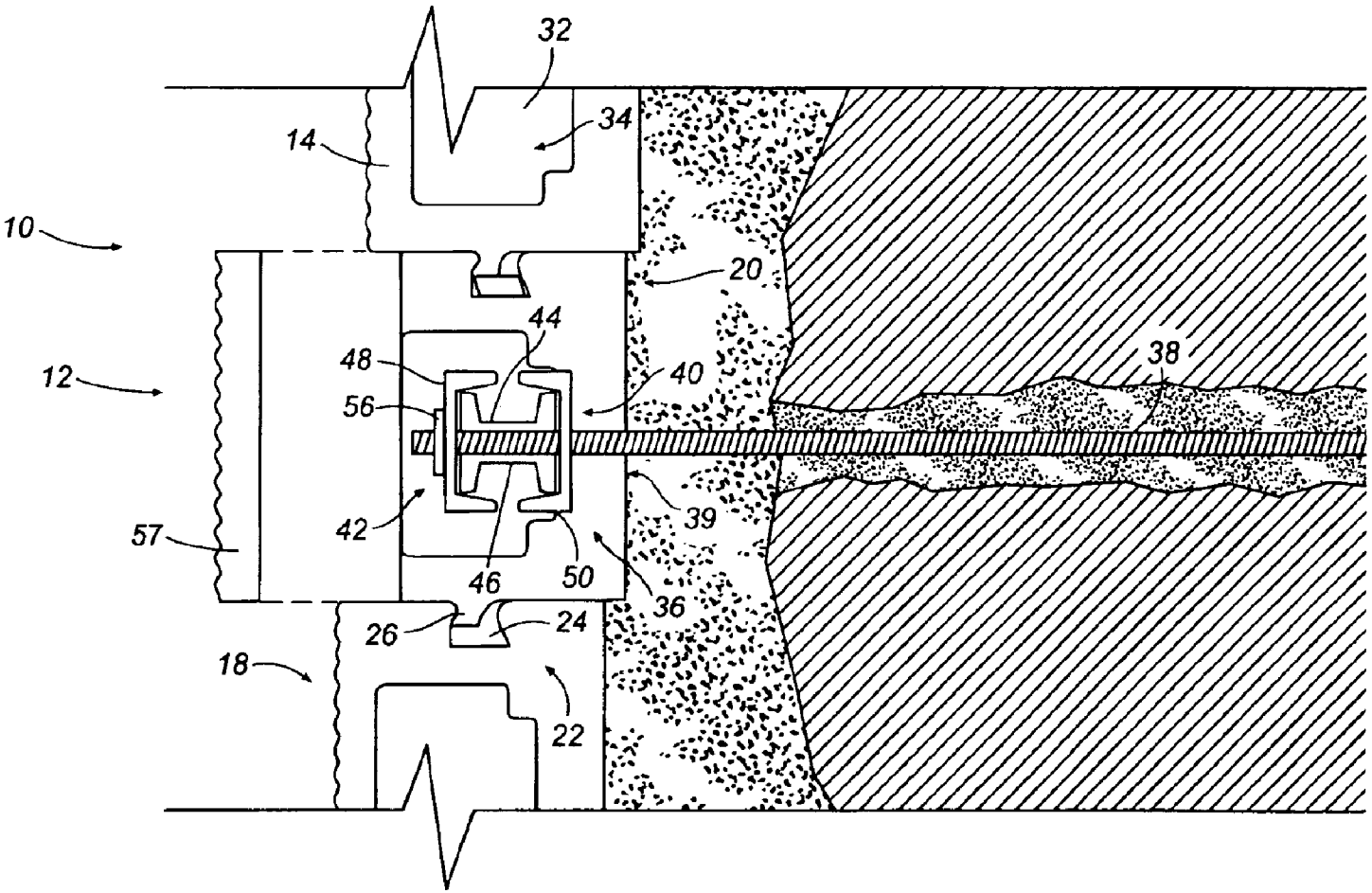
FIG. 2 is a partial cross-sectional view of a retaining wall which shows a tieback connection of an anchoring system constructed in accordance with the present invention.

As indicated in FIGS. 1–3, the retaining wall 10 is secured in several predetermined points with tieback connections 36. Typically, each tieback connection 36 is spaced approximately 10 feet apart horizontally from each other to form rows of tieback connections that are approximately 2.5 feet apart vertically from each other. Accordingly, each tieback rod 38 is embedded into the soil and/or rock in these intervals. As shown in FIG. 2, each tieback rod 38 extends through an opening 39 formed in the rear surface of its respective wall block 14 such that a proximal portion 40 of the rod 38 extends into the continuous elongated passageway. Also positioned within the passageway 34 is a tieback rod attachment mechanism 42. The attachment mechanism 42 normally includes a pair of elongated force distribution members 44, 46 that extend from one tieback rod 26 to the next along the passageway 34 and which are positioned above and below the tieback rods 38 as indicated in FIG. 1. Typically, each force distribution member 44, 46 comprises an elongated channel beam that is flanged so as to cooperate more readily with washers described below. Arranged in this manner, each passageway 34 having tieback rods 38 extending therein includes a plurality of force distribution members 44, 46 aligned end to end both above and below the rods. To maintain parallel spacing between the force distribution members 44, 46, the attachment mechanism 42 can include spacers 47 that are positioned adjacent each rod 38 on both sides of the rod as indicated in FIG. 1. Normally, the height of these spacers 47 generally approximates the diameter of the tieback rods 38.

As shown in FIG. 2, a pair of flanged washers 48, 50 partially surround the upper and lower pairs of force distribution members 44 and 46, and are fitted about each tieback bar 38. To accommodate the rearmost 50 of the washers, each wall block 14 accommodating a tieback rod 38 normally is provided with an inner channel 54 that is sized and configured for receipt of the washer 50. Threaded onto each tieback rod 38 is a conventional threaded fastener 56 such as a nut which, when fully tightened, urges the washers 48, 50 inwardly to securely hold the force distribution members 44, 46 in position, thereby securing the rod to the wall 10. Normally, this tightening is achieved by accessing the interior of the block 14 by removing a face covering portion 57 of the block. Once fully tightened, the fastener 56 can be bonded in place with epoxy to prevent its inadvertent loosening. After the fastener 56 has been fixed in place, the face covering portion 57 of the block 14 can be secured to the block so that it matches the other blocks forming the wall. Configured in this manner, each tieback connection 36 evenly distributes any forces exerted on the tieback rods 38 throughout the wall 10 to greatly improve wall integrity.

Figure 4:
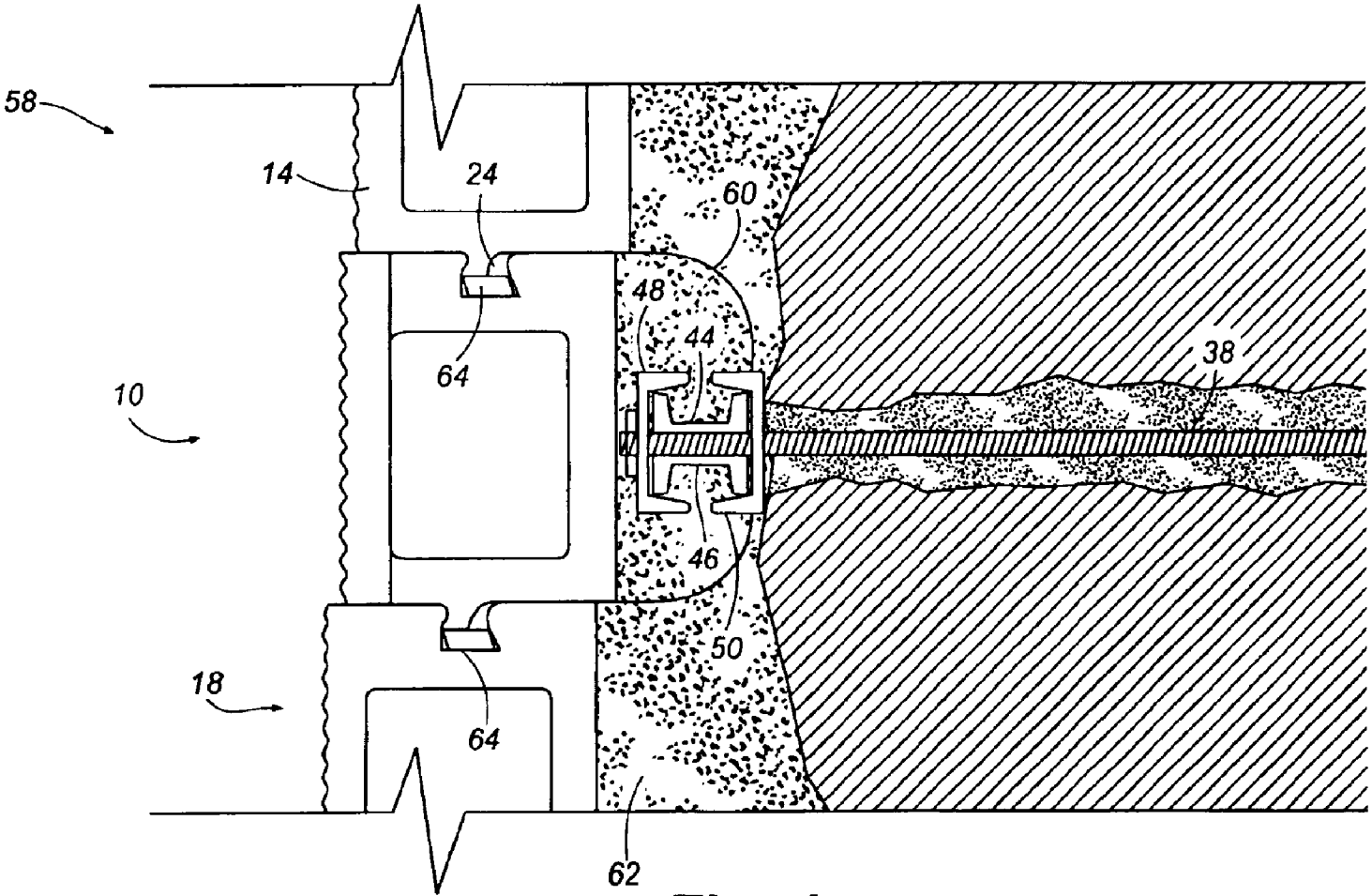
FIG. 4 is a partial cross-sectional view of a retaining wall which shows a tieback connection of an anchoring system constructed in accordance with the present invention.

FIG. 4 illustrates a second embodiment 58 of an anchoring system constructed in accordance with the present invention. This embodiment is structurally similar to the system depicted in FIGS. 1–3 and described above. Accordingly, the force distribution members 44, 46, flanged washers 48, 50, as well as the fastener 56, are used to secure the tieback rods 38 to the wall 10. However, in this embodiment, the rods 38 are secured with a reinforcement member 60 such as a geogrid wrap instead of directly to a wall block 14 such that the reinforcement member 60 is positioned outside of but adjacent to the interior surface 20 of the wall. Because of this arrangement, the blocks 14 need not comprise interior openings 32, as in the first embodiment. Preferred for the construction of the reinforcement member 60 is geogrid material that comprises flexible fabric composed of a polymeric material such as polypropylene or high tenacity polyester. As shown most clearly in FIG. 4, the reinforcement member 60 extends from the exterior surface 18 of the retaining wall 10, into a lock channel 24 of the lower adjacent wall block 14, out from the wall and into a portion of the stone fill 62 formed between the wall and the soil and/or rock, wraps around the force distribution members 44, 46, and then extends back underneath the upper adjacent block 14 (into the wall), into the lock channel 24 of the upper adjacent block, and back to the exterior surface of the wall 18, tracing a substantially C-shaped path.

In the wall system illustrated in FIG. 4, the reinforcement member 60 is locked to the wall 10 with a pair of retaining bars 64 that are positioned in the two lock channels 24 adjacent the tieback rod 38. These retaining bars 64 lie atop the reinforcement member 60 and holds it against the rear walls of the locking channels 24 to prevent the reinforcement member from being pulled out from the retaining wall 10. Although such retaining means are preferred, it will be understood that other types of retaining means could be used. When a tensile force is applied to the tieback rod 38 and translated to the reinforcement member 60, the retaining bars 64 are urged towards the rear wall of the channels 24, locking the reinforcement member in place. Thus, like the system of the first embodiment, the anchoring system of the second embodiment similarly distributes the forces exerted by the soil and/or rock of the embankment throughout the retaining wall 10.

While preferred embodiments of the invention have been disclosed in detail in the foregoing description and drawings, it will be understood by those skilled in the art that variations and modifications thereof can be made without departing from the spirit and scope of the invention. For instance, although the anchoring system of the first embodiment herein is described and shown in use with a retaining wall having horizontal inner passageways, it is to be appreciated that this systems easily could be adapted for use with a retaining wall having vertical inner passageways.

What is claimed is:

1. A retaining wall anchoring system for a segmental retaining wall having a transverse passageway formed therein extending through a plurality of segmental retaining wall blocks in the wall, the anchoring system comprising:

at least one tieback rod adapted to be embedded into soil or rock with a proximal portion of the tieback rod extending into the transverse passageway; and a force distribution member adapted to be positioned within the transverse passageway, to extend through a plurality of the segmental retaining wall blocks and to be connected to the tieback rod;

wherein tensile forces imposed on the tieback rod are transmitted to the force distribution member so as to distribute the tensile forces throughout a plurality of the retaining wall blocks in the retaining wall.

2. The system of claim 1, further comprising at least one washer positionable about the proximal portion of the tieback rod in abutment with the force distribution member.

3. The system of claim 1, further comprising at least one fastener adapted to be fixedly secured to the proximal portion of the tieback rod to securely clamp the force distribution member to the tieback rod.

4. The system of claim 3, wherein the proximal portion of the tieback rod is threaded and the fastener comprises at least one threaded nut.

5. The system of claim 1, comprising at least two force distribution members adapted to be positioned on opposite sides of the tieback rod.

6. The system of claim 1, wherein the force distribution member is flanged.

7. The system of claim 1, further comprising two washers which are positionable on opposite sides of the force distribution member so as to clamp the force distribution member therebetween.

8. The system of claim 7, wherein each washer is flanged so as to be adapted to partially surround the force distribution member.

9. A segmental retaining wall comprising a plurality of segmental retaining wall blocks, the wall comprising:

a transverse passageway formed within the wall through a plurality of the segmental retaining wall blocks;

a plurality of spaced tieback rods embedded into soil or rock and each having a proximal portion extending into the transverse passageway; and a force distribution member positioned within the transverse passageway, extending through a plurality of the retaining wall blocks and being connected to the tieback rods;

wherein tensile forces imposed upon the tieback rods are transmitted to the force distribution member so as to distribute the tensile forces throughout a plurality of the retaining wall blocks in the retaining wall.

10. The wall of claim 9, further comprising a plurality of washers positioned about the proximal portions of the tieback rods in abutment with the force distribution member.

11. The wall of claim 9, further comprising a plurality of fasteners fixedly secured to the proximal portions of the tieback rods that securely clump the force distribution member to the tieback rods.

12. The wall of claim 11, wherein the proximal portions of the tieback rods are threaded and the fasteners comprise threaded nuts.

13. The wall of claim 9, comprising at least two force distribution members disposed within the transverse passageway on opposite sides of the tieback rods.

14. The wall of claim 9, wherein the force distribution member is flanged.

15. The wall of claim 9, further comprising a plurality of washers positioned on opposite sides of the force distribution member so as to clamp the force distribution member therebetween.

16. The wall of claim 15, wherein each washer is flanged so as to partially surround the force distribution member.

* * * * *

UNITED STATES PATENT AND TRADEMARK OFFICE

CERTIFICATE OF CORRECTION

PATENT NO. : 6,935,812 B2
DATED : August 30, 2005
INVENTOR(S) : Rainey

It is certified that error appears in the above-identified patent and that said Letters Patent is hereby corrected as shown below:

Column 1,
Line 12, delete “continuation-in-pan” and insert -- continuation-in-part --;

Column 6,
Line 28, delete “clump” and insert -- clamp --.

Signed and Sealed this

Sixteenth Day of May, 2006

JON W. DUDAS
*Director of the United States Patent and Trademark Office*